US006547290B1

(12) United States Patent
Zenner et al.

(10) Patent No.: US 6,547,290 B1
(45) Date of Patent: Apr. 15, 2003

(54) STRESS REDUCING PLUNGER TUNNEL FOR AN IMPROVED DOOR HANDLE HOUSING

(75) Inventors: Christopher Richard Zenner, Alta Vista, IA (US); Jason Robert Scanlan, Fredericksburg, IA (US)

(73) Assignee: Tri/Mark Corporation, New Hampton, IA (US)

( * ) Notice: Subject to any disclaimer, the term of this patent is extended or adjusted under 35 U.S.C. 154(b) by 0 days.

(21) Appl. No.: 09/823,010

(22) Filed: Mar. 30, 2001

(51) Int. Cl.[7] ..... E05C 1/12

(52) U.S. Cl. ..... 292/173; 292/167; 292/170; 292/DIG. 51; 292/DIG. 31; 70/208; 70/448

(58) Field of Search ..... 292/167, 170, 292/173, DIG. 51, DIG. 57, DIG. 31, 337; 70/208, 448

(56) References Cited

U.S. PATENT DOCUMENTS 3,785,686 A * 1/1974 Armstrong ..... 292/336.3
4,320,642 A * 3/1982 Pastva, Jr. ..... 70/472
4,335,595 A * 6/1982 Swan et al. ..... 70/149
5,058,937 A * 10/1991 Miehe et al. ..... 292/34
5,265,450 A 11/1993 Doyle ..... 70/118
RE36,209 E * 5/1999 Walls ..... 292/173
6,000,097 A * 12/1999 Russell ..... 16/114.1

FOREIGN PATENT DOCUMENTS

FR 1282044 A1 * 12/1961

* cited by examiner

*Primary Examiner*—Anthony Knight
*Assistant Examiner*—Chris Boswell
(74) *Attorney, Agent, or Firm*—McKee, Voorhees & Sease, P.L.C.

(57) ABSTRACT

An improved door handle is provided with a housing having a plunger tunnel designed to dissipate stress forces, such as door seal loads and vibration. The plunger tunnel is D-shaped in cross-section, with a curved interior radius to preclude stress concentrations. The plunger has a complimentary D-shaped cross-section for sliding movement within the tunnel between extended and retracted positions to latch and unlatch the door.

20 Claims, 4 Drawing Sheets

STRESS REDUCING PLUNGER TUNNEL FOR AN IMPROVED DOOR HANDLE HOUSING

BACKGROUND OF THE INVENTION

Door handles are subjected to various stresses, including door seal loads and vibration. Over time, such stresses may lead to failure or fracture of the door handle. In particular, the plunger tunnel of the door handle housing is subject to fracture or failure due to excessive or repetitive forces. Prior art plunger tunnels are generally constructed with relatively thin walls with square interior and exterior corners which concentrate the stress forces, thereby causing premature failure.

Accordingly, a primary objective of the present invention is the provision of a door handle with an improved plunger tunnel to dissipate stresses, thereby minimizing or eliminating fracture and failure.

Another objective of the present invention is the provision of a door handle housing having a plunger tunnel which is D-shaped in cross-section.

A further objective of the present invention is the provision of a plunger tunnel on a door handle housing having thickened corners to dissipate forces.

Another objective of the present invention is the provision of a door handle housing with a plunger tunnel wherein the rearward interior corners are curved to avoid stress concentration.

Still another objective is the provision of an improved door handle which is economical to manufacture and durable in use.

These and other objectives become apparent from the following description of the invention.

BRIEF SUMMARY OF THE INVENTION

The improved door handle of the present invention includes a housing adapted to be mounted in a door structure. A paddle is pivotally mounted in the housing for movement between open and closed positions to latch and unlatch the door handle relative to the door structure. The housing includes a plunger tunnel, with a plunger slidably mounted within the tunnel for actuation by the paddle. The plunger tunnel has a substantially square exterior perimeter and a D-shaped interior perimeter so as to define thickened rearward corners adapted to dissipate stresses to which the door handle is subjected, thereby minimizing or eliminating failure and fracture of the tunnel.

DETAILED DESCRIPTION OF THE INVENTION

Figure 1:
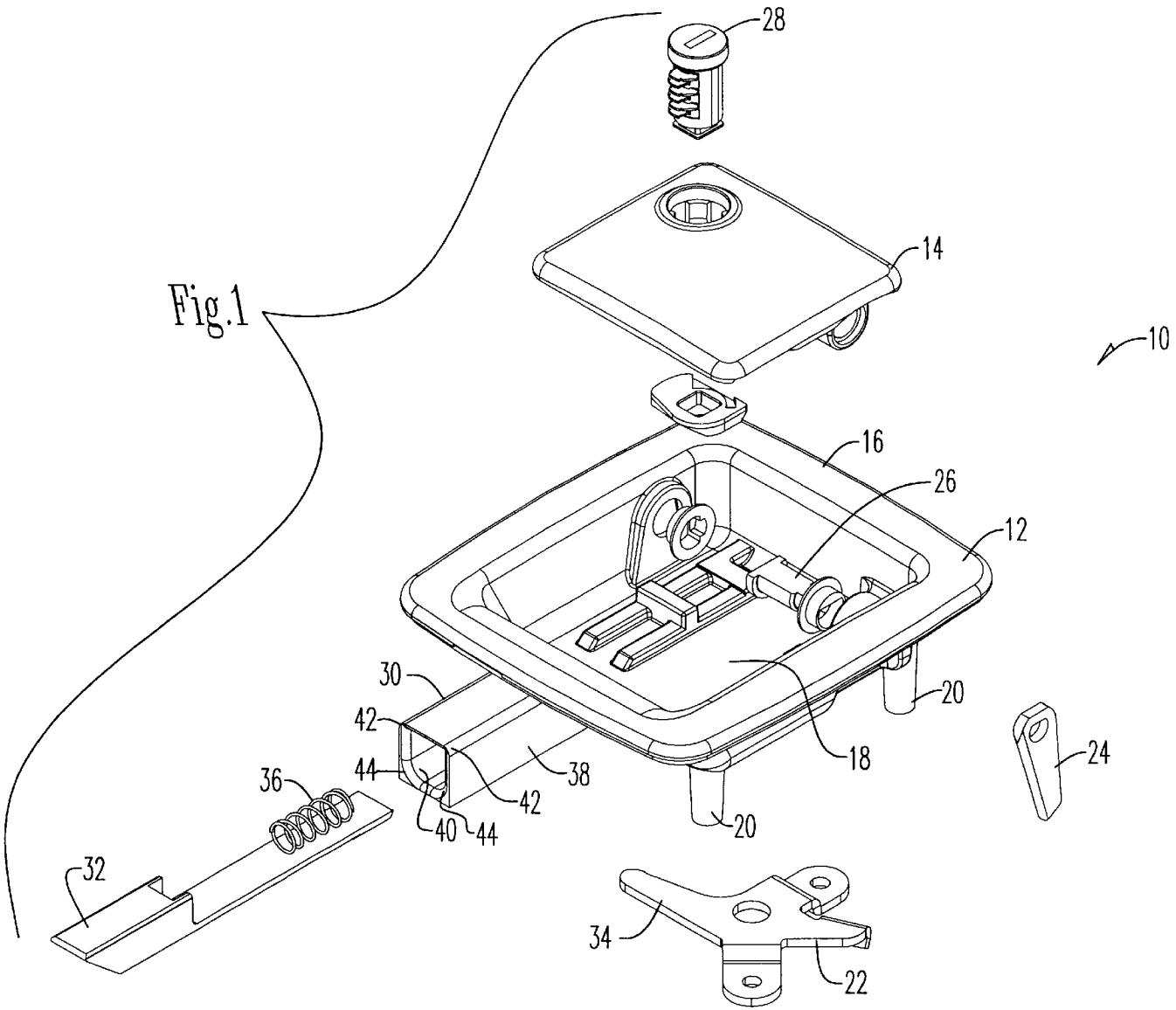
FIG. 1 is an exploded perspective view of the door handle of the present invention.

With reference to the drawings, the door handle of the present invention is generally designated by the reference numeral 10. The handle 10 includes a housing 12 and a paddle 14 pivotally mounted within the housing 12 for latching and unlatching the handle 10. The housing 12 includes a perimeter flange 16 and a recessed body 18, with mounting legs 20 for mounting the housing 12 to a door structure (not shown). A pivot plate 22 is pivotally mounted on the bottom of the recessed body 18, and is actuated by a pivot arm 24 mounted on the axle 26 on which the paddle 14 is mounted. A key cylinder 28 is operatively mounted within the door handle 10 to permit the handle to be locked and unlocked with a key (not shown).

The above-described structure of the door handle 10 is conventional and does not constitute a part of the present invention.

Figure 2:
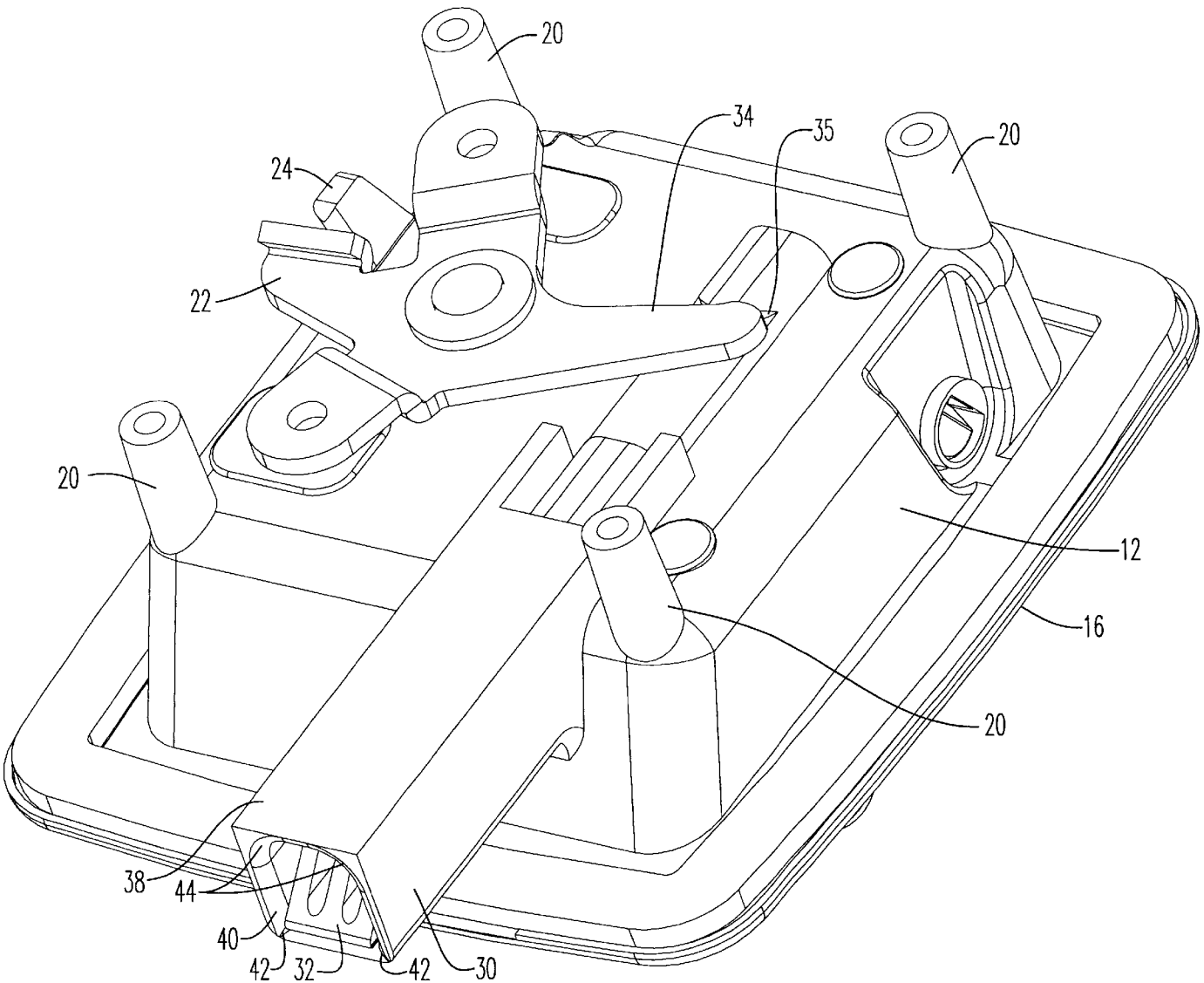
FIG. 2 is a rear perspective view showing the plunger in a retracted position.
Figure 3:
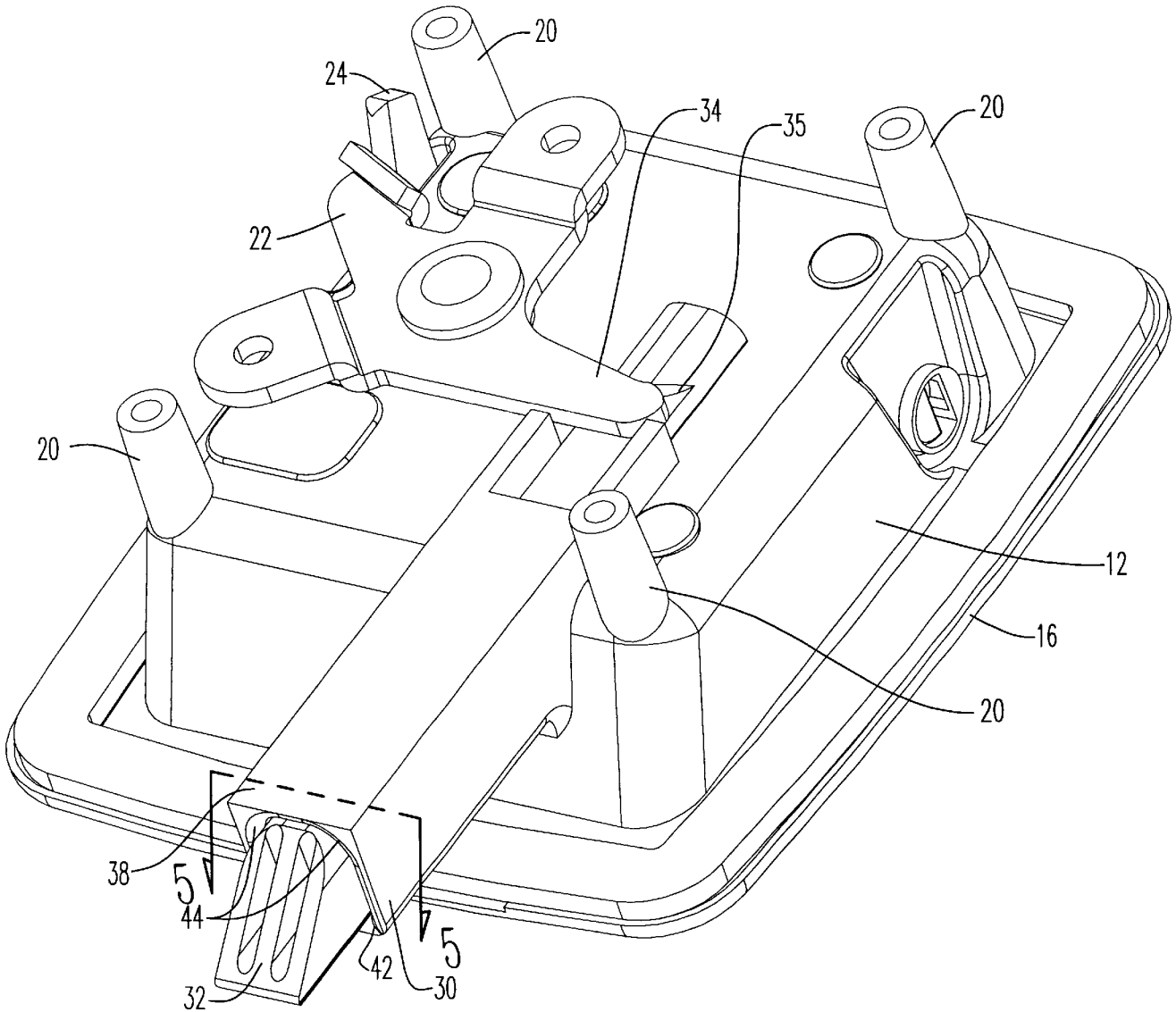
FIG. 3 is a rear perspective view showing the plunger in an extended position.
Figure 4:
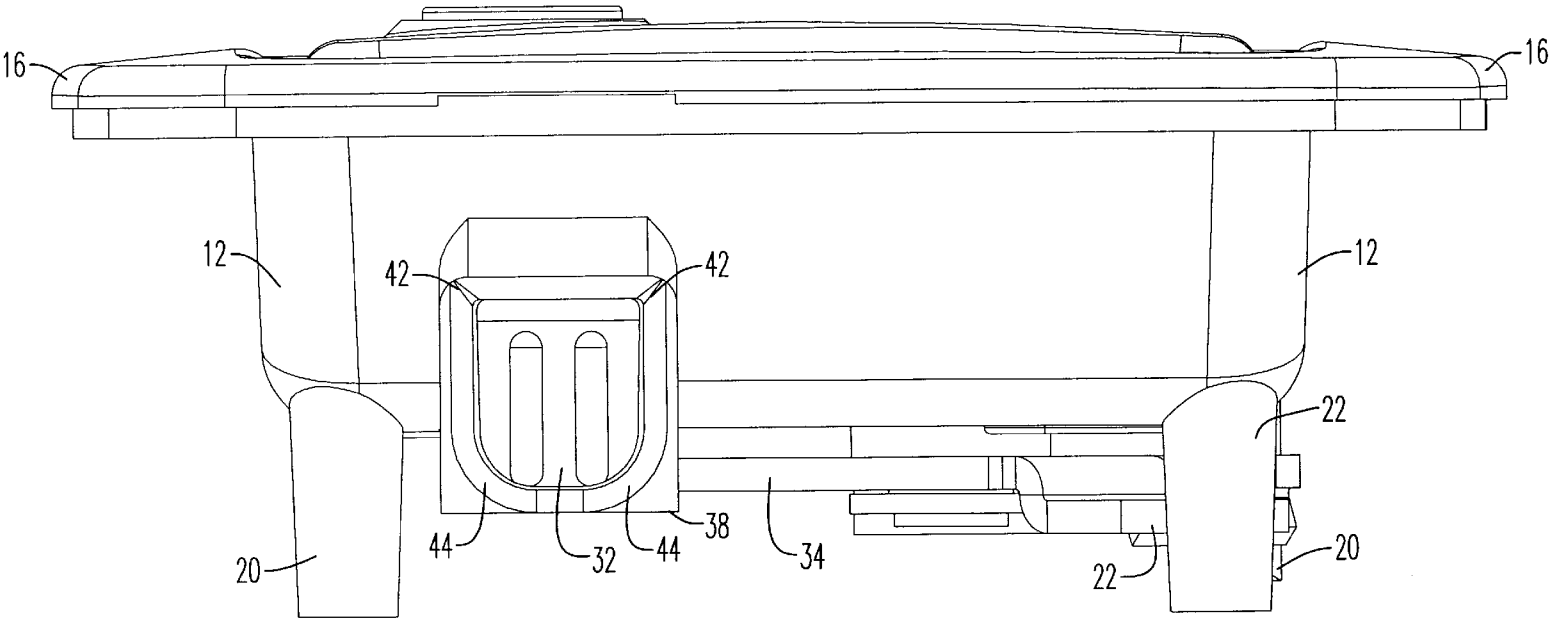
FIG. 4 is a side elevation view of the door handle.
Figure 5:
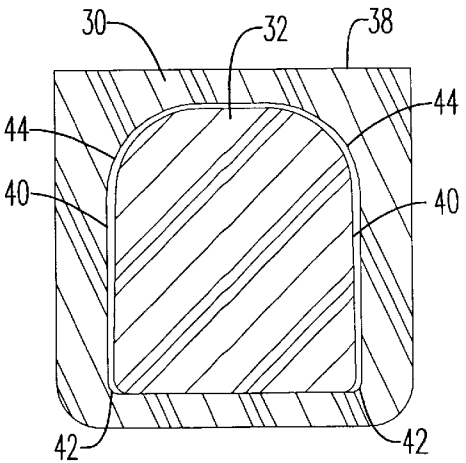
FIG. 5 is a sectional view taken along lines 5—5 of FIG. 3.

The present invention is directed towards the plunger tunnel 30, which is formed on the housing 12. The plunger tunnel 30 extends beyond the perimeter flange 16 of the housing 12, and slidably receives a plunger 32. The plunger 32 is moveable within the tunnel 30 between a retracted positioned shown in FIG. 2 and an extended position shown in FIG. 3. Movement of the plunger 32 is controlled by the pivot plate 22, which includes an arm 34 which engages a shoulder 36 on the rearward end of the plunger 32. The plunger 32 is normally biased to the extended position by a spring 36. The arm 34 is connected to the axle 26, such that opening the paddle 14 pivots the arm 34, which in turn pivots the plate 22 so as to retract the plunger 32, as seen in FIG. 2, thereby unlatching the handle 10 from the door structure.

The plunger tunnel 30 is constructed so as to dissipate stress forces, such as door seal loads and vibration. More particularly, the plunger tunnel 30 has a substantially rectangular or square outer perimeter 38 and a D-shaped inner perimeter 40. Thus, the plunger 30 has forward corners 42 and rearward corners 44, with the rearward corners 44 having a curved inner radius so as to have an increased thickness relative to the forward corners 42. Accordingly, the plunger tunnel 30 minimizes or eliminates concentrations of stress at the rearward corners 44, thereby minimizing fractures and failures, and enhancing the life of the housing 12.

The housing 12, including the improved plunger tunnel 30, has dimensions which allow the door handle 10 to be retrofit in place of prior art door handles that are prone to fracture and failure from stress forces.

Accordingly, the present invention accomplishes at least all of the stated objectives.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An improved door handle, comprising:

a housing with a plunger tunnel, the housing being adapted for mounting in a door structure;

a plunger slidably mounted in the plunger tunnel;

a paddle pivotally mounted on the housing for movement between open and closed positions;

a pivot plate pivotally mounted on the housing and engaging the plunger to move the plunger between extended and retracted positions with respect to the tunnel in response to movement of the paddle between the closed and open positions; and the plunger tunnel having a D-shape in cross-section to dissipate stress.

2. The door handle of claim 1 wherein the plunger has a D-shape in cross-section.

3. The door handle of claim 1 wherein the housing includes a perimeter edge and the tunnel extends beyond the perimeter edge.

4. The door handle of claim 1 wherein the tunnel is unsupported by the door structure.

5. The door handle of claim 1 wherein the tunnel has a substantially square external perimeter and a D-shaped internal perimeter.

6. The door handle of claim 1 wherein the tunnel has four corners, two of which have an enlarged inside radius.

7. The door handle of claim 1 wherein the tunnel and plunger are matingly shaped in cross-section.

8. An improved housing for a door handle, the housing being adapted to pivotally mount a paddle for actuating a plunger to latch and unlatch the door relative to a door frame, the improvement comprising:

a plunger tunnel adapted to slidably receive the plunger, the tunnel having interior and exterior perimeters with different cross-sectional shapes.

9. The improved housing of claim 8 wherein the interior perimeter has a D-shaped cross-section.

10. The improved housing of claim 9 wherein the exterior perimeter is substantially rectangular in cross-section.

11. The improved housing of claim 8 wherein the tunnel has four corners, and at least two corners have an increased thickness to dissipate stress applied to the tunnel.

12. The improved housing of claim 8 wherein the tunnel has forward and rearward corners, with the rearward corners being thicker than the forward corners to provide increased strength to the tunnel.

13. The improved housing of claim 8 wherein the tunnel is unsupported by the door.

14. The improved housing of claim 8 wherein the housing has a perimeter flange, and the tunnel extends beyond the flange.

15. The improved housing of claim 8 wherein the tunnel has curved interior corners.

16. An improved door handle, comprising:

a housing with a plunger tunnel, the housing being adapted for mounting in a door structure;

a plunger slidably mounted in the plunger tunnel;

a paddle pivotally mounted on the housing for movement between open and closed positions;

a pivot plate pivotally mounted on the housing and engaging the plunger to move the plunger between extended and retracted positions with respect to the tunnel in response to movement of the paddle between the closed and open positions; and the plunger tunnel having curved interior corners to avoid stress concentration.

17. The door handle of claim 16 wherein the tunnel has a D-shaped interior cross-section.

18. The door handle of claim 16 wherein the tunnel is unsupported by the door structure.

19. The door handle of claim 16 wherein the plunger is complimentary in shape to the tunnel.

20. The door handle of claim 16 wherein the tunnel has a substantially rectangular outer perimeter.

* * * * *